US006873243B1

(12) United States Patent
Karnes et al.

(10) Patent No.: US 6,873,243 B1
(45) Date of Patent: Mar. 29, 2005

(54) SMALL-FOOTPRINT FUSE

(75) Inventors: Joshua D. Karnes, Cedar Park, TX (US); Martin Lindquist, Kelowna (CA); Louis E. Fischer, Austin, TX (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/982,733

(22) Filed: Oct. 18, 2001

(51) Int. Cl.[7] ..... H01H 85/38
(52) U.S. Cl. ..... 337/278; 337/276; 337/273
(58) Field of Search ..... 337/159, 186, 337/187, 273, 276–282, 290, 295, 296, 297

(56) References Cited

U.S. PATENT DOCUMENTS 2,302,820 A * 11/1942 Van Liempt ..... 337/185
3,786,388 A * 1/1974 Sato ..... 337/269
3,953,818 A * 4/1976 Martin et al. ..... 337/191
4,071,837 A * 1/1978 Ranzanigo ..... 337/268
4,198,617 A * 4/1980 Hara ..... 337/403
4,441,093 A * 4/1984 Okazaki ..... 337/404
4,599,597 A * 7/1986 Rotbart ..... 337/206
4,635,023 A * 1/1987 Oh ..... 337/163
5,572,181 A * 11/1996 Kiryu et al. ..... 337/273
5,858,454 A * 1/1999 Kiryu et al. ..... 427/118
5,883,562 A * 3/1999 Matsuoka et al. ..... 337/273
5,936,509 A * 8/1999 Norte et al. ..... 337/290
6,462,925 B2 * 10/2002 Kanamaru et al. ..... 361/93.8

* cited by examiner

*Primary Examiner*—Anatoly Vortman
(74) *Attorney, Agent, or Firm*—Campbell Stephenson Ascolese LLP; Justin M. Dillon

(57) ABSTRACT

A method and an apparatus for protecting an electrical circuit against excessive currents by a fuse assembly. The fuse assembly is configured to interrupt the flow of current through the electrical circuit by increasing dielectric separation between two ends of a fuse element prepared in a form substantially representing a curve. The fuse element is coupled to a pair of conductive endcaps and a dielectric material substantially encloses the fuse element between the endcaps. The method of increasing dielectric separation between two ends of a fuse element includes preparing the fuse element in the form substantially representing the curve, coupling the fuse element between a pair of conductive endcaps, and enclosing the fuse element in a dielectric material which is formed such that a portion of the dielectric material extends into the area bounded by the fuse element and a line intersecting the two ends of the fuse element.

52 Claims, 10 Drawing Sheets

300
Gap 230
318
320

320
Dielectric Material #1 340
Dielectric Material #2 342
Fuse Element 250
Plate 355
315
Arc 257
Dielectric Material #1 340
Dielectric Material #2 342
323
320
Plate 355
Gap 230
320

321
315
Dielectric Material #1 340
Dielectric Material #2 342
Fuse Element 250
Plate 355
318
Fuse Element 250

Conductive Endcaps 320
315
300

SMALL-FOOTPRINT FUSE

BACKGROUND OF THE INVENTION

1. Field of the Invention

The present invention relates to electrical fuses. More specifically, the present invention relates to a method and an apparatus for protecting an electrical circuit against excessive currents by a fuse assembly configured to interrupt the flow of current through the electrical circuit by increasing dielectric separation between two ends of a fuse element.

2. Description of the Related Art

A fuse is a safety device that typically protects electrical circuits from the effects of excessive currents, e.g., during an overload condition. The electrical circuit may be overloaded due to excessive current caused by abnormal operation of the electrical circuit, abnormal changes in the load and/or abnormal changes in the electrical circuit's inputs. Most electrical devices such as computers, telecommunications equipment, amplifiers, TV's, and products with embedded electrical systems such as automobiles, aircraft, heating and cooling systems and even space vehicles typically include a protective device, e.g., a fuse.

Printed circuit boards ("PCB"), or the like, on which electrical and/or electronic components are mounted to form electrical circuits are well known in the art. Conventional printed circuit boards typically include through-hole and/or surface mounted components. The surface mounted components are typically mounted on PCB's using surface mounted technology ("SMT"). The fuse is an example of a component included in a typical printed circuit board. In the quest to build printed circuit board assemblies with improved circuit protection that is smaller, faster, and safer, fuse developers are extending their expertise in optimizing the fuse design by improving the operating characteristics and by reducing the footprint.

A fuse assembly typically includes a current-conducting fuse element, e.g., a strip or wire of easily fusible conducting material capable of heating and melting, a dielectric material enclosing the fuse element, and a pair of conducting terminals connected to the fuse element. As is well known, the dielectric material does not readily conduct electricity. Whenever the circuit protected by the fuse is made to carry a current larger than that for which it is intended, the fuse element typically generates heat due to the excessive current flowing through the element, gets heated to its melting point and eventually melts. The melting of the fuse element causes the element to be split transversely into at least two smaller elements separated by a gap. The separation of the element into two elements and a gap, due to melting, has the effect of interrupting the flow of current through the circuit. Depending on the voltage potential across the gap, electrical breakdown of the poor dielectric inside the fuse such as air, or arcing, may occur between the two smaller, separated elements.

Fuses may be packaged differently depending on the application. For example, a screw-bulb-type fuse, commonly used in earlier domestic electrical systems, contains a short bit of wire (the fusible element) enclosed in a dielectric container, e.g., glass, which has a screw-threaded base. The wire is connected to metal terminals at both the screw base and at the side, and the fusible element is viewable for seeing whether the fuse element has melted. The cartridge-type fuse, a type of fuse widely used in industry where high currents are involved, has a fusible element connected between conducting metal terminals at either end of a cylindrical insulating tube, which is typically made from glass or ceramic.

Traditional printed circuit boards have used the cartridge type fuse. The TeleLink® SM fuse manufactured by Teccor Electronics, Irving, Tex., USA, is an example of a cartridge-type fuse used in printed circuit boards with surface mounted components.

A problem with traditional fuses is heat generation caused by arcing across the gap due to high interrupting voltage. The voltage potential between the two remaining pieces of the fuse element may be sufficient to overcome the insulation provided by the air or other substance in the gap and cause arcing. In general, arcing during fuse operation generates an excessive amount of heat. The excessive amount of heat often results in fracture of the tube enclosing the fuse element. Metallic vapor resulting from the molten fuse element may be ejected from the fuse assembly onto the surrounding circuitry potentially causing a short circuit and potentially resulting in an unsafe operation of the electrical circuit.

Moreover, the printed circuit board area consumed by a fuse may be significant in view of a continued emphasis on miniaturization and increased board densities. A balance of structural strength of the fuse body, the length of the fuse element, and the length of the gap formed by a melting fuse element have been optimized in the TeleLink® SM fuse. Further reductions in size or the required space on a printed circuit board have not been realized due the effect of high-intensity arcing between the two ends of the element. Thus, it is desirable to reduce the footprint of the traditional fuse, while minimizing such arcing.

SUMMARY OF THE INVENTION

It has been discovered that a method and apparatus may be used for protecting an electrical circuit against excessive current by a fuse assembly. The method and apparatus thereof for interrupting the flow of current through the electrical circuit is described.

In one embodiment, the fuse assembly is configured to interrupt the flow of current through the electrical circuit by increasing dielectric separation between two ends of a fuse element by preparing the fuse element in a form substantially representing a curve. The fuse element is coupled to a pair of conductive endcaps and a dielectric material substantially encloses the fuse element between the endcaps.

In this embodiment, the method of increasing dielectric separation between the two ends of the fuse element includes preparing the fuse element in the form substantially representing the curve, coupling the fuse element between the pair of conductive endcaps, and enclosing the fuse element in the dielectric material. The dielectric material is formed such that a portion of the dielectric material extends into the area bounded by the fuse element and a line intersecting the two ends of the fuse element.

In another embodiment, the fuse assembly is configured to reduce the footprint or the pitch of the fuse element. In this embodiment, the method of reducing the footprint of the fuse element includes preparing the fuse element in the form substantially representing the curve, coupling the fuse element between the pair of conductive endcaps, and enclosing the fuse element in the dielectric material. The footprint of the fuse element is reduced when compared with a conventional fuse because the endcaps can be placed closer to one another without a corresponding reduction in the length of the gap formed by the opening of the fuse element.

In another embodiment, the fuse assembly is configured to reduce the footprint of the pitch of the fuse element. In this embodiment, the method of reducing the footprint of the fuse element includes configuring the outside surface of the fuse body into a shape which includes an air gap between the two end caps thereby introducing an increased tracking surface distance between the two end caps.

In another embodiment, the fuse assembly is configured to reduce the footprint of the pitch of the fuse element. In this embodiment, the method of reducing the footprint of the fuse element includes configuring the outside surface of the fuse body into a shape which includes a protruded form of the fuse body between the two end caps thereby introducing an increased tracking surface distance between the two end caps.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A printed circuit board that incorporates the method and apparatus for increasing dielectric separation between two ends of a fuse element may be included in virtually any and all electrical devices such as computers, telecommunications equipment, amplifiers, TV's, and DVD players. The printed circuit board may also be incorporated in products with embedded electrical systems such as automobiles, aircraft, appliances, heating and cooling systems and even space vehicles. The fuse element preferably protects an electrical circuit included on the printed circuit board against excessive current. In one embodiment, the printed circuit board may be included in a network computer system described below.

Figure 1:
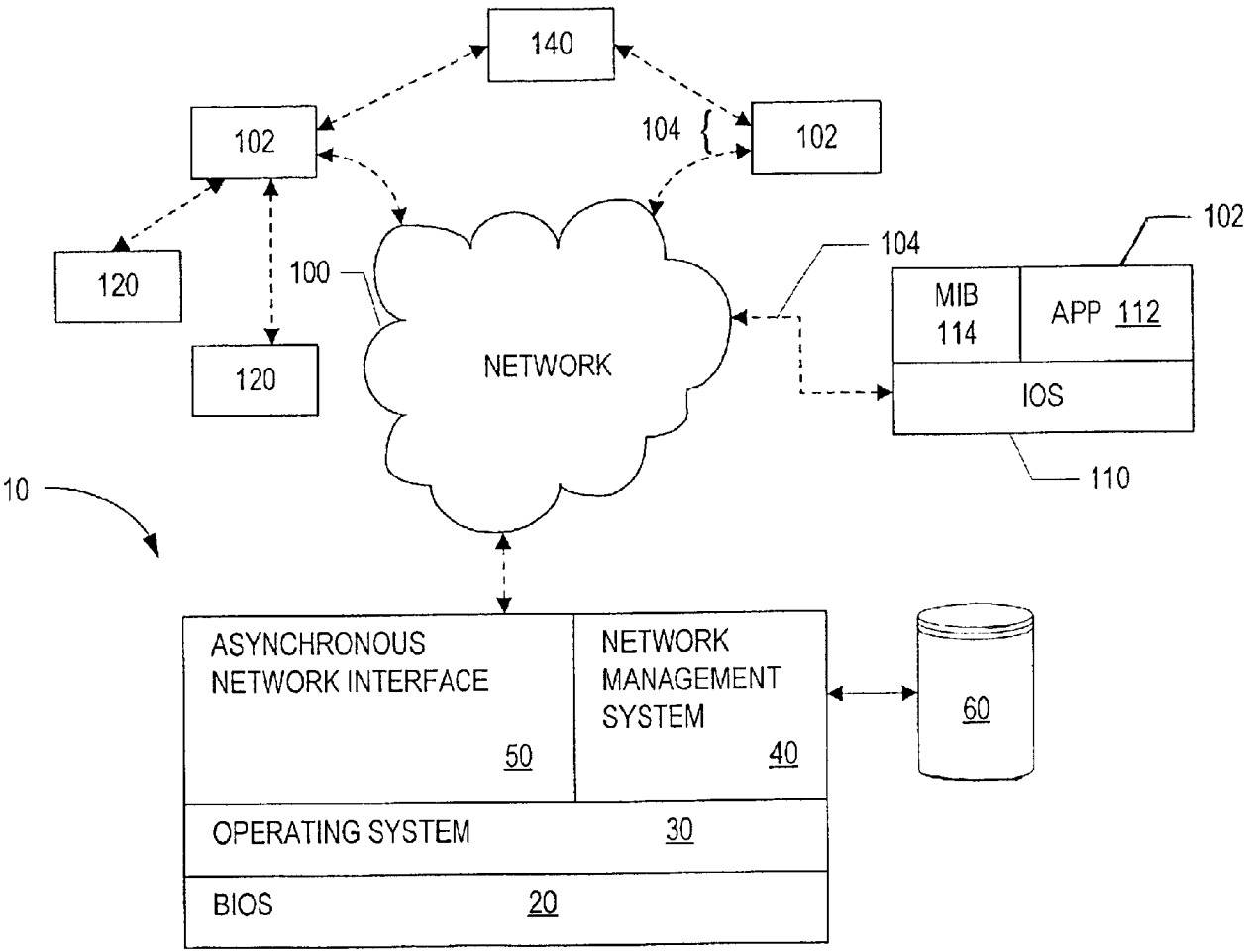
FIG. 1 shows a simplified diagram of a network that is managed by a network management station.

FIG. 1 is a simplified diagram of a network 100 that is managed by a network management station 10. The network 100 comprises one or more network devices 102, such as switches, routers, bridges, gateways, and other devices. Each network device 102 is coupled to another network device 102, or to one or more end stations 120. The coupling of network device 102 to the network 100 may be enabled by using communications lines such as T1, E1, E3, DSL, ISDN, and voice (POTS) phone. Each end station 120 is a terminal node of the network 100 at which some type of work is carried out. For example, an end station 120 is a workstation, a printer, a server, or similar device.

Each network device 102 typically executes a network-oriented operating system 110. An example of a network-oriented operating system is the Internetworking Operating System (IOS) commercially available from Cisco Systems, Inc. Each network device 102 may also execute one or more applications 112 under control of the operating system 102. The operating system 102 supervises operation of the applications 112 and communicates over network connections 104 using an agreed-upon network communication protocol, such as Simplified Network Management Protocol (SNMP).

Each device 102 stores information about its current configuration, and other information, in a Management Information Base (MIB) 114. Information in the MIB 114 is organized in one or more MIB variables. The network management station 10 can send fetch and set commands to the device 102 in order to retrieve or set values of MIB variables.

Preferably, every electrical circuit included in network 100, and/or any node coupled to the network 100 e.g., the network management station 10 or network device 102, incorporates the method and apparatus for increasing dielectric separation between two ends of a fuse element as described further herein. The fuse element preferably protects the circuit included in network 100 against excessive currents and/or over-voltages. Every printed circuit board included in network 100, and/or any node coupled to the network 100 preferably includes the fuse element with a reduced footprint. Advantageously, the reduced footprint of the fuse element enables higher densities for components mounted on the printed circuit boards included with the hardware of network 100, and/or any node coupled to the network 100.

The network management station 10 executes one or more software components that carry out the functions shown in block diagram form in FIG. 1. For example, the network management station 10 executes a basic input/output system (BIOS) 20 that controls and governs interaction of upper logical layers of the software components with hardware of the network management station. An example of BIOS is the Phoenix ROM BIOS. The network management station 10 also executes an operating system 30 that supervises and controls operation of upper-level application programs. An example of a suitable operating system is the Microsoft Windows NT® operating system.

The network management station 10 executes an asynchronous network interface 50 or ANI under control of the operating system 30. The ANI 50 provides an interface to the network 100 and communicates with the network using SNMP or another agreed-upon protocol. The ANI 50 provides numerous low-level services and functions for use by higher-level applications.

The network management station IO executes a network management system 40 that interacts with a database 60 containing information about the managed network 100. The network management system 40 is an example of a network management application. Using a network management application, a manager can monitor and control network components. For example, a network management application enables a manager to interrogate devices such as host computers, routers, switches, and bridges to determine their status, and to obtain statistics about the networks to which they attach. The network management application also enables a manager to control such devices by changing routes and configuring network interfaces. Examples network management applications are Cisco Works, Cisco Works for Switched Internetworks (CWSI), and Cisco View, each of which is commercially available from Cisco Systems, Inc.

Figure 2A:
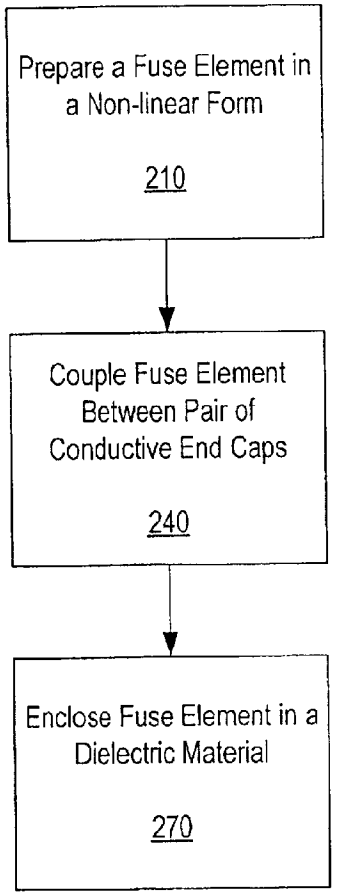
FIG. 2A shows a flow chart of a method of increasing dielectric separation between two ends of a fuse element.

FIG. 2A is a diagram illustrating a flow chart of a method of increased dielectric separation between two ends of a fuse element that may experience arcing. During an excessive current condition, at least a portion of the fuse element may heat excessively and subsequently melt or break at any point. Thus the two ends of a breakpoint in the fuse element may experience arcing. In some cases, the fuse element may experience melting or breaking at multiple points.

The physical fuse element is generally three-dimensional. The shape of the three-dimensional fuse element may vary, depending on a variety of factors such as the application requirement, and the manufacturer. For example, the shape of one fuse element may be cylindrical. The shape of another fuse element may be spiral, wrapped around a cylindrical dielectric. The axis of a traditional three-dimensional fuse element is typically linear. The form of the traditional fuse element may also be described as linear.

In step 210, in one embodiment, the traditional fuse element is prepared in a non-linear form (e.g., such that the axis of the fuse element substantially represents a curve in two dimensions). A two-dimensional curve may be defined as any two-dimensional collection of points. A three-dimensional curve, e.g., a three-dimensional spiral, may be defined as any three-dimensional collection of points that are not in the same plane. The shape of the fuse element in this embodiment may be described as non-linear. The non-linear shape may be substantially represented by a curve. As is well known, a curve may be formed by the end-to-end placement of a large number of linear segments. Depending on the number of linear segments used to form the curve, the shape of the curve may, in some cases, be represented by an angle. In one embodiment, a form of the fuse element may be represented by two sides of a triangle.

In step 240, fuse element 250 is coupled between a pair of conductive endcaps. The pair of conductive endcaps include a first end (or terminal) and a second end (or terminal). The first and second ends are used to couple the fuse element to the electronic circuit being protected. In step 270, fuse element 250 is enclosed in a fuse body made of a dielectric material, preferably with a high dielectric constant such as glass, ceramic or the like. The shape of the dielectric material is adapted to enclose fuse element 250 prepared in a substantially in a non-linear form, described below. In one embodiment, fuse element 250 may be enclosed by the dielectric material. In another embodiment, fuse element 250 may be protected within a tube or a container made from a dielectric material. The tube or container may then be enclosed within another dielectric material that makes up the fuse body. The space therein may be filled with a material, e.g., air or the like, within the tube or container that may include an inert gas, e.g., helium, argon or krypton or the like, bounded by the space between fuse element 250, the dielectric body and the pair of conductive endcaps. This material is typically a dielectric material whose dielectric constant is preferably lower than that of the dielectric material which constitutes the fuse body, making it a poorer dielectric. Alternatively, the space therein may be evacuated.

Figure 2B:
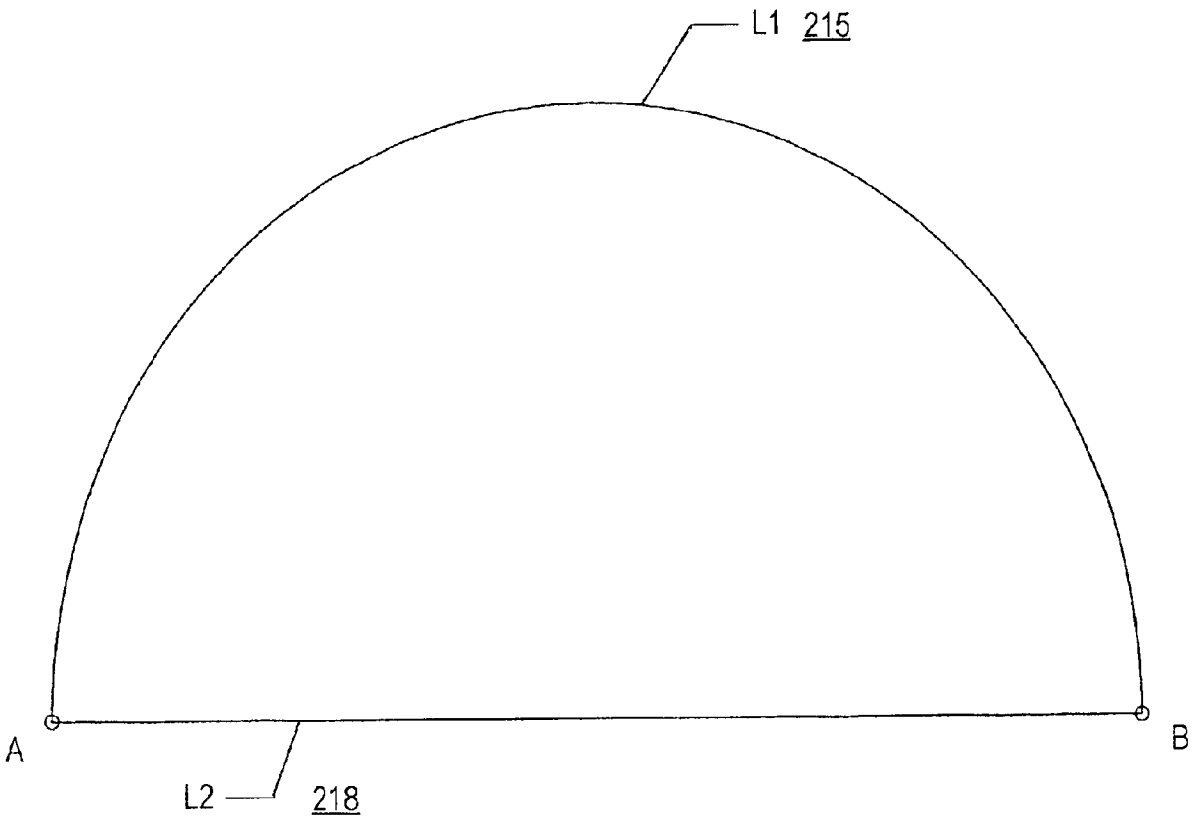
FIG. 2B shows a fuse element axis prepared in a form substantially representing a curve.

FIG. 2B is a diagram illustrating the axes of a traditional fuse element in linear form L2 218 and in a substantially curve form L1 215. The linear distance along a curve joining points A and B, e.g., arc length L1 215, is greater than the shortest distance between points A and B, i.e., straight line L2 218 joining points A and B. By configuring the axis of a fuse element in a substantially non-linear form, e.g., curved form along an arc length or along the perimeter of the curve, the electrical separation between two ends of the fuse element, or between two ends of a fuse element that may experience arcing will generally be greater, especially when compared to a linear fuse element. In addition, by configuring the axis of a fuse element in a non-linear form, the arcing process may be impeded by preferably introducing a superior dielectric barrier, e.g., glass, ceramic or other material that composes the fuse body, between the two ends. While performing a comparison between two dielectric materials A and B, A may typically be described to be a superior dielectric material if A offers a higher dielectric constant compared to the B dielectric material. B is typically described as a poorer dielectric material compared to A.

Figure 2D:
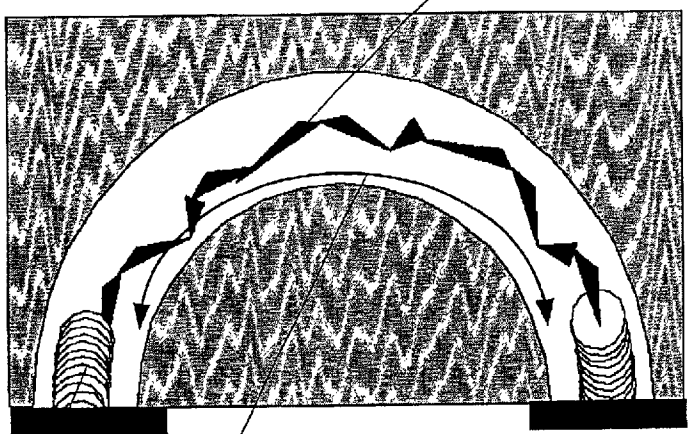
FIGS. 2C–D show a curved fuse element during an arcing process.
Figure 2C:
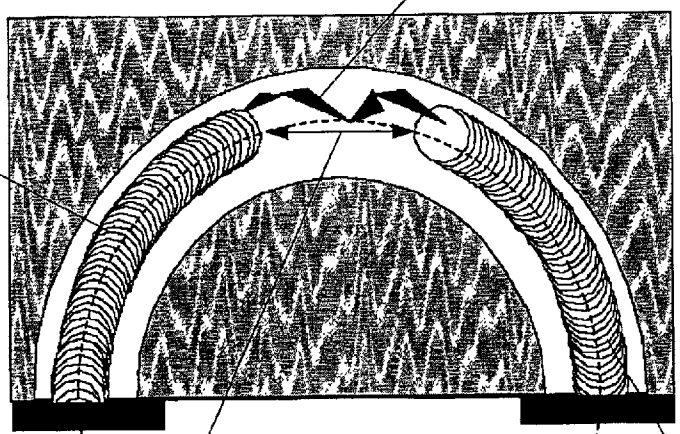

FIG. 2C illustrates a fuse element 250 with a gap 230 and an arc 255 across a gap 230. An axis 201, shown as a dotted line, of fuse element 250 is in a substantially non-linear form, curved form. Fuse element 250 is also described to be in a substantially non-linear form. An electrical arc (such as arc 255) generally follows a path of least resistance. In one embodiment, the path of least resistance is through the poor dielectric such as air or the like which fills the space within the fuse body surrounding the fuse element, as described in FIG. 2A above. Arc 255 is forced to travel along a path, which is consistent with the curved path of fuse element 250 and is also consistent with the shape of the dielectric material, which composes the fuse body separating the ends. The dielectric material is typically made from a material such as glass, ceramic or other material with a superior dielectric constant compared to air.

FIG. 2D illustrates fuse element 250 after erosion and melting caused by continued arcing. The dielectric separation between the ends increases due to a greater amount of dielectric material such as air, which fills the space within the fuse body that surrounds the fuse element between the ends. The dielectric material included within the fuse body preferably extends into the area bounded by the fuse element and a line intersecting the two ends of the fuse element. The likelihood of an arc at any given voltage is thereby reduced in proportion to the increase in dielectric separation afforded by the substantially curved form of the dielectric material and fuse element 250.

The preparation of fuse element 250 in a non-linear form can also enable a reduction in the footprint of the fuse element. The endcaps are typically coupled to a pair of leads (for use with through-hole PCB mounting techniques) or a pair of pads (for PCB using SMT mounting techniques). The pair of leads or pads typically couples the fuse to other electrical circuit components mounted on the printed circuit board. The area of fuse pads plus the area between pads and any area around the fuse necessitated by circuit board assembly requirements may be described as the footprint of fuse assembly. Fuse element 250 may also be used to reduce pitch, the pitch being defined as the center to center space between two adjacent legs of an SMT fuse. The non-linear (e.g., substantially curved) form of fuse element 250 may be prepared so that the distance separating the pair of conductive endcaps, or between the pair of leads/pads, is adjusted to a desirable distance. The reduced footprint (or the reduced pitch) of fuse assembly may be advantageously used to reduce the size of the printed circuit board and/or increase the density of the components included on the printed circuit board.

The path of arc 255 in FIG. 2D follows a longer path distance along a curve formed by the superior dielectric barrier composed of the fuse body. By introducing a superior dielectric barrier such as glass, ceramic or the like, which composes the fuse body between the ends of fuse element 250, further arcing, heat generation and potential damage to the electrical circuit is also impeded.

Figure 3A:
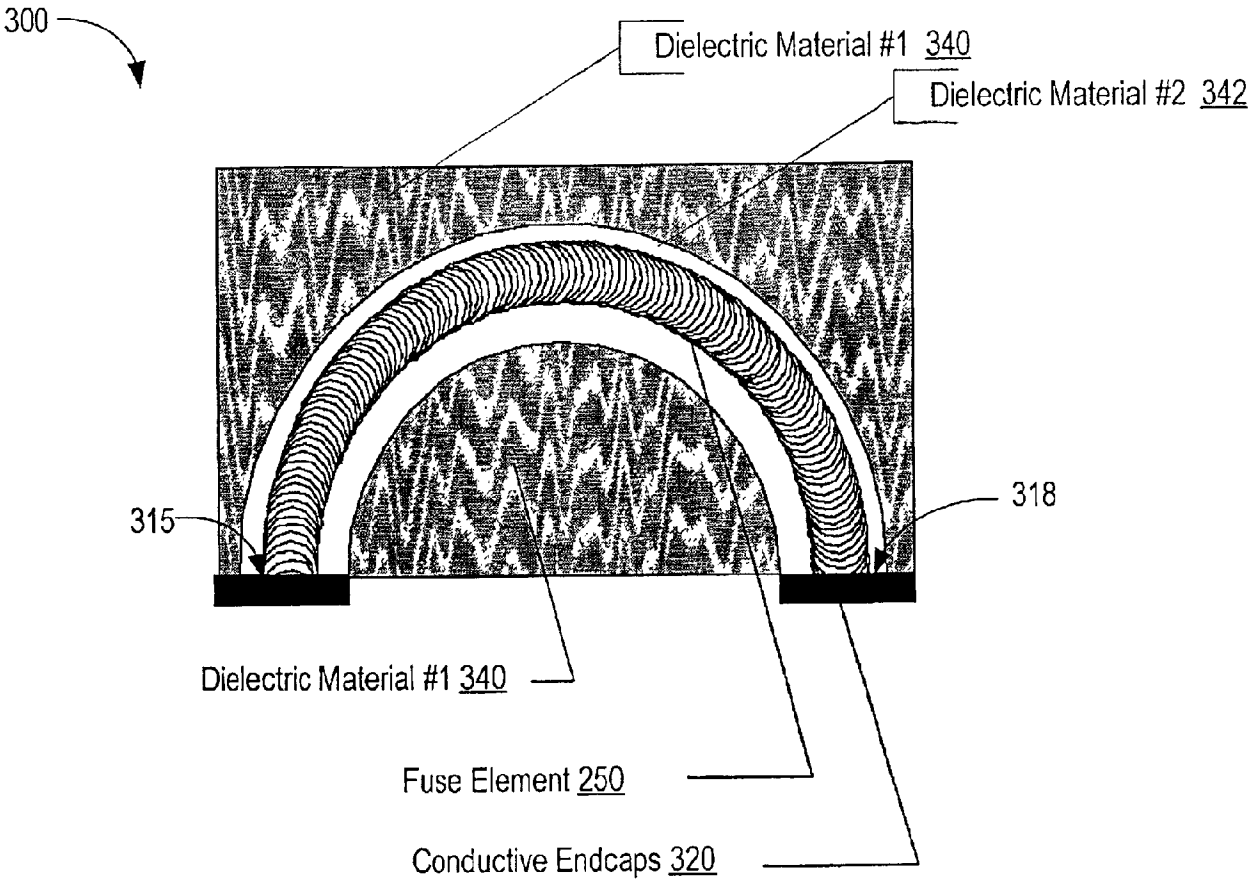
FIG. 3A shows a schematic diagram illustrating a fuse assembly.

FIG. 3A illustrates a fuse assembly 300. The fuse assembly 300 includes fuse element 250 in a form substantially representing a curve. The dielectric materials therein may be configured in several ways. For example, dielectric material #1 340 may be composed of a superior dielectric such as glass, ceramic or the like, and dielectric material #2 342 may be composed of a poorer dielectric such as air and may include an inert gas, e.g., helium, argon or krypton or the like. Fuse element 250 includes a first end 315 and a second end 318. The specific form and shape of fuse element 250 may vary based on implementation requirements. Examples of factors, which may affect the fuse element form, may include factors such as the geometry of the printed circuit board, maximum height of components included on the printed circuit board, and fuse current and voltage ratings.

Fuse assembly 300 also includes a pair of conductive endcaps 320 coupled to first end 315 and second end 318. Dielectric material #1 340 substantially encloses fuse element 250 between endcaps 320. In one embodiment, fuse assembly (not shown) may be modified to include multiple fuse elements with multiple end caps. In one example, a fuse assembly may include at least one fuse element with at least two endcaps. In another example, the fuse assembly may include at least two fuse elements, with each fuse element including at least two end caps.

Figure 3B:
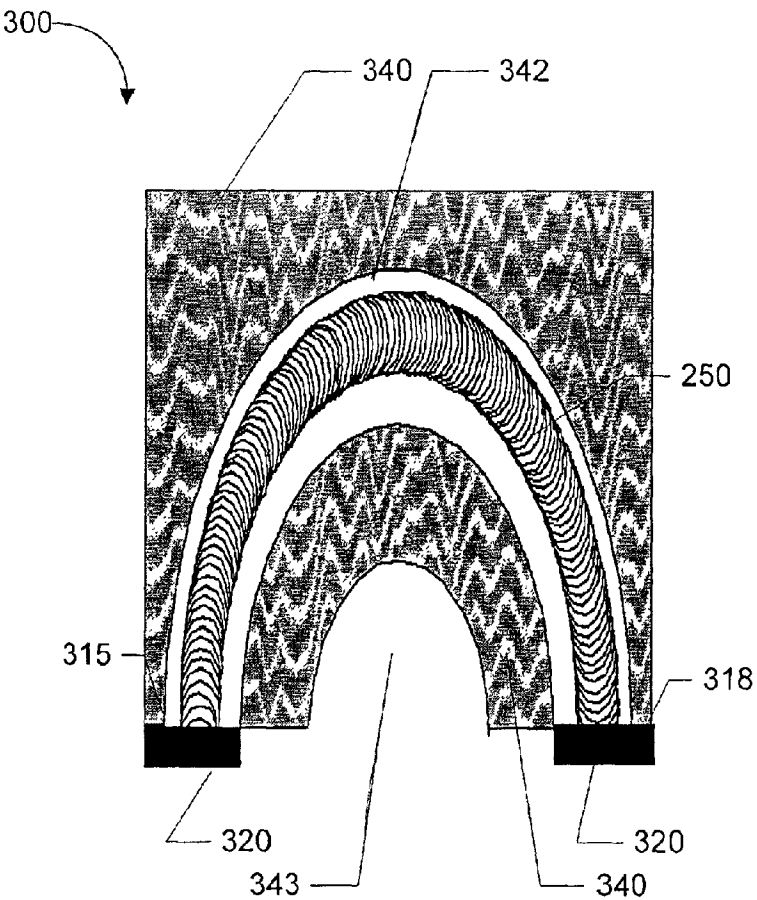
FIG. 3B illustrates one embodiment of a form of the fuse assembly.

FIG. 3B illustrates another embodiment of a form of fuse element 250. The surface of the fuse body composed of dielectric material #1 340 which is bounded by endcaps 320 represents a surface over which electric breakdown might occur through the air or other substance which exists in the environment surrounding the fuse, particularly between endcaps 320. Electrical breakdown such as this may leave a conductive carbon path along any surface which is in contact with the arc resulting from the breakdown. This carbon path reduces the insulating value of the dielectric material #1 340. The air gap 343 facilitates an increase in the distance along the surface of the fuse body composed of dielectric material #1 340 which is bounded by endcaps 320, which improves the insulating value of the dielectric material #1 340 after a carbon path has been produced as a result of an electrical breakdown between the endcaps 320. As stated previously, in one embodiment, the substantially curved form of fuse element 250 is prepared so that the distance separating the pair of conductive endcaps, or the pair of leads/pads, is reduced to a desired length. The reduced footprint of the fuse element may be advantageously used to reduce the size of the printed circuit board and/or increase the density of the components included on the printed circuit board.

Figure 3C:
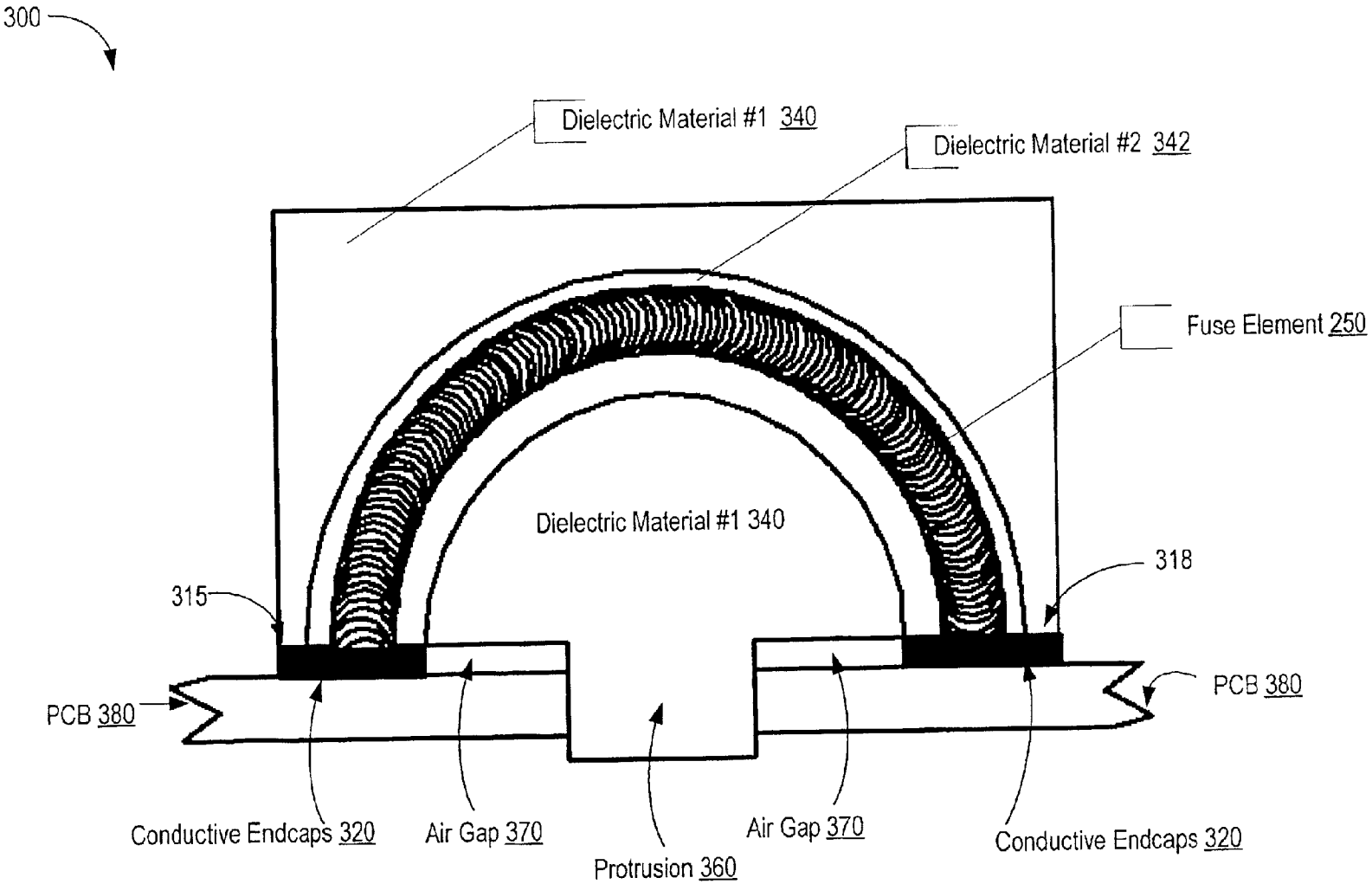
FIG. 3C illustrates one embodiment of a form of the fuse assembly.

In one embodiment, as further arcing is impeded (e.g., as illustrated in FIG. 2D) there may, however, still exist a finite probability that an electrical breakdown may still occur between the endcaps 320. The probability may be even greater for a reduced footprint fuse. The electrical breakdown may occur between the endcaps 320 and may occur external to the fuse body, e.g., there may be a breakdown in the dielectric surrounding the fuse. In this embodiment, at least a portion of dielectric material #1 340 is positioned between an area bounded by prepared fuse element 250 and a line connecting at least two endcaps 320. FIG. 3C illustrates one embodiment of a form of fuse element 250 with dielectric material #1 340 in a protruded form, e.g., with a protrusion 360. At least a portion of the protrusion 360 is positioned between at least two endcaps 320 thereby impeding arcing between at least two endcaps 320. An external surface of the fuse body composed of dielectric material #1 340 and which is bounded by endcaps 320 represents one such surface over which electric breakdown might occur. The dielectric medium present between the endcaps 320 and external to the fuse body, e.g., air gap 370 that exists in the environment surrounding the fuse body and particularly between endcaps 320, may breakdown. In this embodiment, the electrical breakdown may leave a conductive carbon path along a surface that may be in contact with the arc resulting from the breakdown. For example, a conductive carbon path may be deposited on the external surface of the fuse body and/or on the printed circuit board ("PCB") 380 directly underneath the mounted fuse. The carbon path reduces the insulating value of dielectric material #1 340. The protrusion 360 in dielectric material #1 340 facilitates an increase in the distance along the surface of the fuse body thereby improving the insulating value of the dielectric material #1 340 after a carbon path has been produced. The protrusion 360 may be mated to a corresponding slot or opening in a printed circuit board ("PCB") 380 assembly upon assembly of an end-use product. As stated previously, in one embodiment, the substantially non-linear form of fuse element 250 is prepared so that the distance separating the pair of conductive endcaps 320, or the pair of leads/pads, is reduced to a desired length. The dielectric material arranged in a protruded form may be advantageously used in a fuse, preferably in a fuse with a reduced footprint, to reduce the size of the printed circuit board and/or increase the density of the components included on the printed circuit board.

Figures 3D, 3E, 3F:
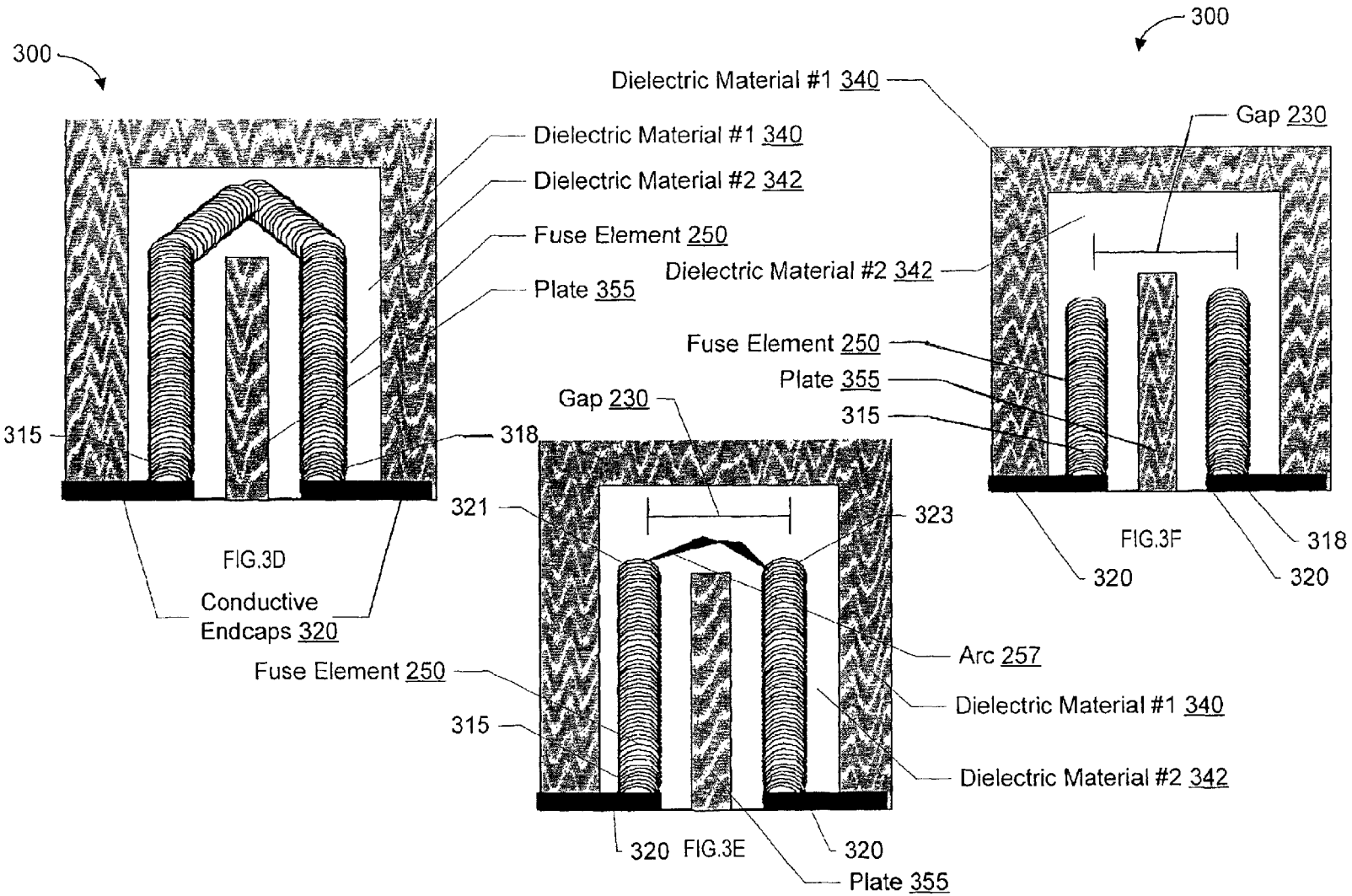
FIGS. 3D–F illustrate one embodiment of a form of the fuse assembly during an arcing process.

FIG. 3D is a diagram illustrating fuse element 250 that is optimized for a small footprint. In one embodiment of such a small footprint fuse, the dielectric material may be in the form of a plate 355 composed of an electrically insulating material. Plate 355 may be placed between the legs of fuse element 250 as illustrated in FIG. 3D. Fuse element 250 prepared in a substantially non-linear form is intended to encompass a fuse that includes a plurality of linear segments joined at angles to each other as depicted in FIGS. 3D–F. As described earlier, the shape of fuse element 250 may, in some cases, be represented by an angle. Fuse element 250 in FIG. 3D, which may incorporate a plurality of linear segments, e.g., four linear segments, is represented by a form represented by an angle.

Referring to FIG. 3E, the middle portion of fuse element 250 is shown to be melted away. As a result of the melting of fuse element 250, gap 230 has been created. Fuse element 250 includes a first end 321 and a second end 323. An arc 257 between the two ends 321 and 323 of fuse element 250 is illustrated.

Referring to FIG. 3F, the further arcing of the remaining ends of fuse element 250 is impeded when plate 355 blocks the path of arc 255. Plate 355, which may be made from dielectric material #1 340, insulates the two halves of fuse element 250 and thereby impedes the arc. The reduced footprint fuse advantageously provides protection from excessive current, and in addition also provides an optimized small size.

Figure 4:
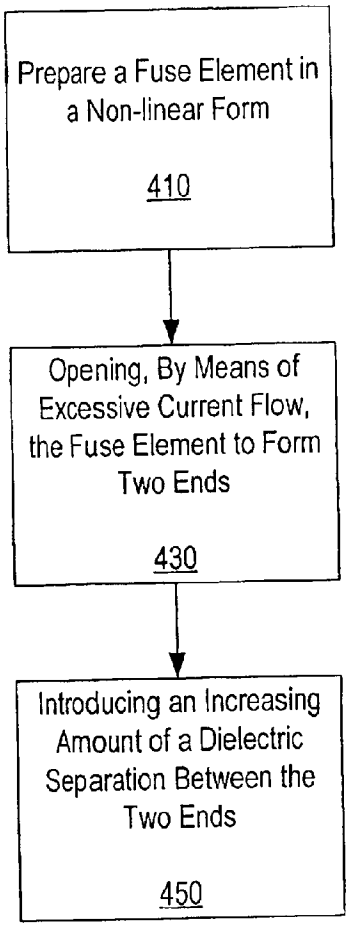
FIG. 4 is a diagram illustrating a flow chart of a method of impeding arcing between two ends of a fuse element.

Referring to FIG. 4, a diagram illustrating one embodiment of a flow chart of a method of impeding arcing between two ends of a fuse element. In step 410, the fuse element is prepared in a non-linear form. In step 430, an excessive current condition results in melting of the fuse element. The melting of fuse element 250 results in the formation of two ends 321 and 323. In step 450, the path of the arc between two ends 321 and 323 is forced to travel around the dielectric material 355 along the curve of fuse element 250 thus introducing an increasing amount of dielectric separation as the ends are further eroded and melted as a result of the high-temperature arc. Thus, the shape of fuse element 250 and insertion of dielectric within the perimeter of the curve of the fuse element causes the automatic introduction of an increased amount of dielectric separation. The increased amount of dielectric separation results in the further impeding of the arc's progress and generally ends in extinguishing arc 257.

Figure 5:
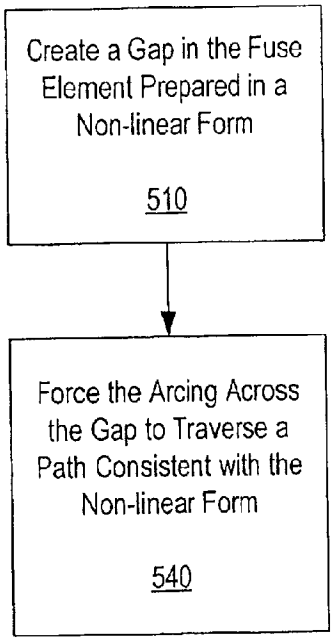
FIG. 5 is a diagram illustrating one embodiment of a flow chart for a method of impeding arcing across a gap formed by the melting of a fuse element.

FIG. 5 is a diagram illustrating one embodiment of a flow chart for a method of impeding arcing across a gap formed by the melting of a fuse element. In step 510, gap 230 is created in fuse element 250. Gap 230 may be created as a result of heat generated in response to excessive current flowing through fuse element 250. In this embodiment, fuse element 250 is prepared in a substantially non-linear form, e.g., a curve.

In step 540, the path of the arc across gap 230, e.g., across two ends 321 and 323, is forced to travel around the dielectric material 355 along the curve of fuse element 250 thus introducing an increasing amount of dielectric separation. Thus, the shape of fuse element 250 and insertion of dielectric within the curve of the fuse element introduces an increased amount of dielectric separation as fuse element 250 is arced away. The increased amount of dielectric separation results in the further impeding of the arc's progress and generally helps to extinguish arc 257. In one embodiment, the dielectric separation may be in the form of plate 355.

In general, use of any specific exemplar herein is also intended to be representative of its class and the non-inclusion of such specific devices in the foregoing list should not be taken as indicating that limitation is desired.

The foregoing described embodiments depict different components contained within, or connected with, different other components. It is to be understood that such depicted architectures are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

Other embodiments are within the following claims.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention.

What is claimed is:

1. A fuse assembly comprising:

a fuse element prepared in a substantially non-linear form, the fuse element comprising at least two terminals, the at least two terminals comprising a first terminal and a second terminal;

at least two conductive endcaps, the at least two conductive endcaps comprising a first conductive endcap and a second conductive endcap, wherein said first conductive endcap comprises a first end coupled to said first terminal and a second end, and said second conductive endcap comprises a first end coupled to said second terminal and a second end, and a fuse body comprising a dielectric material adapted to substantially enclose the fuse element between the at least two endcaps, wherein a first portion of the dielectric material is positioned in an area bounded by said fuse element and a straight line connecting said first terminal and said second terminal to impede arcing across the fuse element, and a second portion of the dielectric material occupies an area from said first ends to said second ends to impede arcing between said first conductive endcap and said second conductive endcap.

2. The fuse assembly of claim 1, wherein the substantially non-linear form of the fuse element comprises a curve.

3. The fuse assembly of claim 1, wherein the fuse element is capable of experiencing arcing as a result of an opening being created in at least a portion of the fuse element, the opening having two ends, and the first portion of the dielectric material forces arcing between the two ends of the opening to traverse a path consistent with the substantially non-linear form.

4. The fuse assembly of claim 3, wherein the dielectric material comprises a superior dielectric material.

5. The fuse assembly of claim 3, wherein the path is consistent with a shape of the first portion of the dielectric material.

6. The fuse assembly of claim 3, wherein the arcing causes formation of a conductive path along a surface of the first portion of the dielectric material.

7. The fuse assembly of claim 6, wherein the conductive path is comprised of carbon.

8. The fuse assembly of claim 6, wherein the conductive path reduces an insulating value of the dielectric material.

9. The fuse assembly of claim 3, wherein said first portion of the dielectric material which forces the arcing between the two ends of the opening to traverse the path introduces an increased amount of dielectric separation.

10. The fuse assembly of claim 3, wherein the opening is created by an excessive current passing through the fuse element, the excessive current causing a meltdown of at least a portion of the fuse element.

11. The fuse assembly of claim 1, wherein said second portion of the dielectric material is positioned substantially along an entire dimension of at least one of said first conductive endcap and said second conductive endcap, and said entire dimension is generally perpendicular to said line connecting said first terminal and said second terminal.

12. The fuse assembly of claim 1, wherein said second portion of the dielectric material is configured to force arcing between said first conductive endcap and said second conductive endcap to traverse a path consistent with a substantially non-linear form.

13. The fuse assembly of claim 1, wherein said at least two conductive endcaps are configured to couple said fuse element to a substrate, and said second portion of the dielectric material comprises a protrusion configured to be mated to a corresponding slot in said substrate.

14. A method of reducing a footprint of a fuse element, the method comprising:

preparing the fuse element in a substantially non-linear form, the fuse element comprising at least two terminals, the at least two terminals comprising a first terminal and a second terminal, the footprint being reduced by adjusting a distance between the first terminal and the second terminal;

coupling the fuse element between at least two conductive endcaps, the at least two conductive endcaps comprising a first conductive endcap and a second conductive endcap, wherein each of said at least two conductive endcaps comprises a first end and a second end, and said coupling comprises, coupling said first terminal to said first end of said first conductive endcap, and coupling said second terminal to said first end of said second conductive endcap; and enclosing the fuse element in a dielectric material, wherein a first portion of said dielectric material is positioned in an area bounded by said fuse element and a straight line connecting said first terminal and said second terminal, and a second portion of said dielectric material occupies an area from said first ends to said second ends to impede arcing between said first conductive endcap and said second conductive endcap.

15. The method of claim 14, wherein the substantially non-linear form of the fuse element comprises a curve.

16. The method of claim 14, wherein the dielectric material comprises a superior dielectric material.

17. The method of claim 14, wherein the substantially non-linear form is consistent with a shape of the first portion of the dielectric material.

18. The method of claim 14, wherein the fuse element is capable of experiencing arcing as a result of an opening being created in at least a portion of the fuse element, the opening having two ends, and the first portion of the dielectric material forces arcing between the two ends of the opening to traverse a path consistent with the substantially non-linear form.

19. The method of claim 18, wherein the opening is created by an excessive current passing through the fuse element, the excessive current causing a meltdown of at least a portion of the fuse element.

20. The method of claim 18, wherein the arcing causes formation of a conductive path along a surface of the first portion of the dielectric material.

21. The method of claim 20, wherein the conductive path is comprised of carbon.

22. The method of claim 20, wherein the conductive path reduces an insulating value of the dielectric material.

23. The method of claim 20, wherein the first portion of the dielectric material which forces the arcing between the two ends of the opening to traverse the path introduces an increased amount of dielectric separation.

24. The method of claim 14, wherein said second portion of said dielectric material is positioned substantially along an entire dimension of at least one of said first conductive endcap and said second conductive endcap, and said entire dimension is generally perpendicular to said line connecting said first terminal and said second terminal.

25. The method of claim 14, wherein said second portion of said dielectric material is configured to force arcing between said first conductive endcap and said second conductive endcap to traverse a path consistent with a substantially non-linear form.

26. The method of claim 14, wherein said at least two conductive endcaps are configured to couple said fuse element to a substrate, and said second portion of said dielectric material comprises a protrusion configured to be mated to a corresponding slot in said substrate.

27. A method of increasing dielectric separation between at least two terminals of a fuse element that experience arcing, the method comprising:

preparing the fuse element in a substantially non-linear form;

coupling the fuse element between at least two conductive endcaps, the at least two conductive endcaps comprising a first conductive endcap and a second conductive endcap, wherein each of said at least two conductive endcaps comprises a first end and a second end, and said coupling comprises, coupling said first end of said first conductive endcap to a first terminal of said at least two terminals, and coupling said first end of said second conductive endcap to a second terminal of said at least two terminals; and enclosing the fuse element in a dielectric material, wherein a first portion of said dielectric material is positioned in an area bounded by said fuse element and a straight line connecting said first terminal and said second terminal to impede arcing across the fuse element, and a second portion of said dielectric material occupies an area from said first ends to said second ends to impede arcing between said first conductive endcap and said second conductive endcap.

28. The method of claim 27, wherein the substantially non-linear form of the fuse element comprises a curve.

29. The method of claim 27, wherein the dielectric material comprises a superior dielectric material.

30. The method of claim 27, wherein the substantially non-linear form is consistent with a shape of the first portion of the dielectric material.

31. The method of claim 27, wherein the arcing causes formation of a conductive path along a surface of the first portion of the dielectric material.

32. The method of claim 31, wherein the conductive path is comprised of carbon.

33. The method of claim 31, wherein the conductive path reduces an insulating value of the dielectric material.

34. The method of claim 27, wherein the fuse element experiences arcing as a result of an opening being created in at least a portion of the fuse element, the opening having two ends, and the first portion of the dielectric material forces arcing between the two ends of the opening to traverse a path consistent with the substantially non-linear form.

35. The method of claim 34, wherein the first portion of the dielectric material which forces the arcing between the two ends of the opening to traverse the path introduces an increased amount of dielectric separation.

36. The method of claim 34, wherein the opening is created by an excessive current passing through the fuse element, the excessive current causing a meltdown of said at least the portion of the fuse element.

37. The method of claim 27, wherein said second portion of said dielectric material is positioned substantially along an entire dimension of at least one of said first conductive endcap and said second conductive endcap, and said entire dimension is generally perpendicular to said line connecting said first terminal and said second terminal.

38. The method of claim 27, wherein said second portion of said dielectric material is configured to force arcing between said first conductive endcap and said second conductive endcap to traverse a path consistent with a substantially non-linear form.

39. The method of claim 27, wherein said at least two conductive endcaps are configured to couple said fuse element to a substrate, and said second portion of said dielectric material comprises a protrusion configured to be mated to a corresponding slot in said substrate.

40. A method of impeding arcing occurring across a gap formed in a fuse element, the method comprising:

creating the gap in the fuse element, the gap being created as a result of heat generated in response to excessive current flowing through the fuse element, the fuse element being prepared in a substantially non-linear form; and forcing the arcing across the gap to traverse a path consistent with the substantially non-linear form, wherein said fuse element is enclosed by a dielectric material and comprises at least two terminals, the at least two terminals comprising a first terminal and a second terminal, said first terminal is coupled to a first conductive endcap, the first conductive endcap comprising a first end coupled to said first terminal and a second end, said second terminal is coupled to a second conductive endcap, the second conductive endcap comprising a first end coupled to said second terminal and a second end, a first portion of said dielectric material is positioned in an area bounded by said fuse element and a straight line connecting said first terminal and said second terminal to impede the arcing, and a second portion of said dielectric material occupies an area from said first ends to said second ends to impede arcing between said first conductive endcap and said second conductive endcap.

41. The method of claim 40, wherein the substantially non-linear form of the fuse element comprises a curve.

42. The method of claim 40, wherein the dielectric material comprises a superior dielectric material.

43. The method of claim 40, wherein the path is consistent with a shape of the first portion of the dielectric material.

44. The method of claim 40, wherein the arcing causes formation of a conductive path along a surface of the first portion of the dielectric material.

45. The method of claim 44, wherein the conductive path is comprised of carbon.

46. The method of claim 44, wherein the conductive path reduces an insulating value of the dielectric material.

47. The method of claim 40, wherein forcing the arcing across the gap to traverse the path introduces an increased amount of dielectric separation.

48. The method of claim 40, wherein the heat generated causes a meltdown of at least a portion of the fuse element.

49. The method of claim 48, wherein the meltdown causes creation of the gap.

50. The method of claim 40, wherein said second portion of said dielectric material is positioned substantially along an entire dimension of at least one of said first conductive endcap and said second conductive endcap, and said entire dimension is generally perpendicular to said line connecting said first terminal and said second terminal.

51. The method of claim 40, wherein said second portion of said dielectric material is configured to force arcing between said first conductive endcap and said second conductive endcap to traverse a path consistent with a substantially non-linear form.

52. The method of claim 40, wherein said conductive endcaps are configured to couple said fuse element to a substrate, and said second portion of said dielectric material comprises a protrusion configured to be mated to a corresponding slot in said substrate.

* * * * *

UNITED STATES PATENT AND TRADEMARK OFFICE

CERTIFICATE OF CORRECTION

PATENT NO. : 6,873,243 B1 
DATED : March 29, 2005
INVENTOR(S) : Joshua D. Karnes, Martin Lindquist and Louis E. Fischer It is certified that error appears in the above-identified patent and that said Letters Patent is hereby corrected as shown below:

Column 9,
Line 63, Claim 1 should read as follows:
-- 1. A fuse assembly comprising:
a fuse element prepared in a substantially non-linear form, the fuse element comprising at least two terminals, the at least two terminals comprising a first terminal and a second terminal;
at least two conductive endcaps, the at least two conductive endcaps comprising a first conductive endcap coupled to said first terminal and a second conductive endcap coupled to said second terminal and
a fuse body comprising a dielectric material adapted to substantially enclose the fuse element between the at least two endcaps, wherein
a first portion of the dielectric material is positioned in an area bounded by said fuse element and a straight line connecting said first terminal and said second terminal to impede arcing across the fuse element, and
a second portion of the dielectric material is positioned directly between said first conductive endcap and said second conductive endcap to impede arcing between said first conductive endcap and said second conductive endcap. --.

Column 11,
Line 1, Claim 14 should read as follows:
-- 14. A method of reducing a footprint of a fuse element, the method comprising:
preparing the fuse element in a substantially non-linear form, the fuse element comprising at least two terminals, the at least two terminals comprising a first terminal and a second terminal, the footprint being reduced by adjusting a distance between the first terminal and the second terminal;
coupling the fuse element between at least two conductive end caps, the at least two conductive endcaps comprising a first conductive endcap coupled to said first terminal and a second conductive endcap coupled to said second terminal; and
enclosing the fuse element in a dielectric material, wherein
a first portion of said dielectric material is positioned in an area bounded by said fuse element and a straight line connecting said first terminal and said second terminal, and
a second portion of said dielectric material is positioned directly between said first conductive endcap and said second conductive endcap to impede arcing between said first conductive endcap and said second conductive endcap. --.

UNITED STATES PATENT AND TRADEMARK OFFICE

CERTIFICATE OF CORRECTION

PATENT NO. : 6,873,243 B1
DATED : March 29, 2005
INVENTOR(S) : Joshua D. Karnes, Martin Lindquist and Louis E. Fischer It is certified that error appears in the above-identified patent and that said Letters Patent is hereby corrected as shown below:

Column 12,
Line 12, Claim 27 should read as follows:
-- 27. A method of increasing dielectric separation between at least two terminals of a fuse element that experience arcing, the method comprising:

preparing the fuse element in a substantially non-linear form;

coupling the fuse element between at least two conductive endcaps, the at least two conductive endcaps comprising a first conductive endcap coupled to a first terminal of said at least two terminals and a second conductive endcap coupled to a second terminal of said at least two terminals; and enclosing the fuse element in a dielectric material, wherein a first portion of said dielectric material is positioned in an area bounded by said fuse element and a straight line connecting said first terminal and said second terminal to impede arcing across the fuse element, and a second portion of said dielectric material is positioned directly between said first conductive endcap and said second conductive endcap to impede arcing between said first conductive endcap and said second conductive endcap. --.

Column 13,
Line 23, Claim 40 should read as follows:
-- 40. A method of impeding arcing occurring across a gap formed in a fuse element, the method comprising:

creating the gap in the fuse element, the gap being created as a result of heat generated in response to excessive current flowing through the fuse element, the fuse element being prepared in a substantially non-linear form; and forcing the arcing across the gap to traverse a path consistent with the substantially non-linear form, wherein said fuse element is enclosed by a dielectric material and comprises at least two terminals, the at least two terminals comprising a first terminal coupled to a first conductive endcap and a second terminal coupled to a second conductive endcap, a first portion of said dielectric material is positioned in an area bounded by said fuse element and a straight line connecting said first terminal and said second terminal to impede the arcing, and

UNITED STATES PATENT AND TRADEMARK OFFICE

CERTIFICATE OF CORRECTION

PATENT NO. : 6,873,243 B1 
DATED : March 29, 2005
INVENTOR(S) : Joshua D. Karnes, Martin Lindquist and Louis E. Fischer It is certified that error appears in the above-identified patent and that said Letters Patent is hereby corrected as shown below:

Column 13 (cont'd), a second portion of said dielectric material is positioned directly between said first conductive endcap and said second conductive endcap to impede arcing between said first conductive endcap and said second conductive endcap. --.

Signed and Sealed this

Fifteenth Day of November, 2005

JON W. DUDAS
*Director of the United States Patent and Trademark Office*